United States Patent [19]

Tawara et al.

[11] 3,947,295

[45] Mar. 30, 1976

[54] HARD MAGNETIC MATERIAL

[75] Inventors: Yoshio Tawara, Shijonawate; Harufumi Senno, Yamato-Koriyama, both of Japan

[73] Assignee: Matsushita Electric Industrial Co., Ltd., Japan

[22] Filed: Feb. 7, 1974

[21] Appl. No.: 440,540

[30] Foreign Application Priority Data

Feb. 9, 1973 Japan ..... 48-16949
May 10, 1973 Japan ..... 48-52409

[52] U.S. Cl. ..... 148/31.57; 75/152; 148/101; 148/103

[51] Int. Cl.[2] ..... H01F 1/04

[58] Field of Search ..... 148/31.57, 101, 103, 105; 75/84, 170, 152, 200

[56] References Cited

UNITED STATES PATENTS

| | | | |
|---|---|---|---|
| 3,540,945 | 11/1970 | Strnat et al. | 148/31.57 |
| 3,546,030 | 12/1970 | Buschow et al. | 148/31.57 |
| 3,560,200 | 2/1971 | Nesbitt et al. | 148/31.57 |
| 3,790,414 | 2/1974 | Tawara et al. | 148/31.57 |

OTHER PUBLICATIONS

Nesbitt, E; New Perm. Mag. Materials Cont. Rare—Earth Metals, in Journ. Appl. Phys., 40, Mar. 1969, pp. 1259–1262.

Nesbitt, et al.; Cast Perm. Mag.—$Co_5$ Re Type with Mixtures of Ce and Sm; in Journ. Appl. Phys., 42, Mar. 1971, pp. 1530–1532.

Nesbitt, et al.; Perm. Mag. Materials, in Applied Physics Letters, June, 1968, pp. 861–862.

Strnat, K., et al.; Mag. Prop. of Rare–Earth–Iron Intermet. Com.; in IEEE Trans. Mag. 1966, pp. 489–493.

*Primary Examiner*—Walter R. Satterfield
*Attorney, Agent, or Firm*—Wenderoth, Lind & Ponack

[57] ABSTRACT

Bulk hardened magnetic materials with compositions expressed by a general formula $Sm_uCe_{1-u}(Co_{1-x-y}Fe_xCu_y)_z$ are provided. Compositions in the limited range of $0.3 \leq u \leq 1.0$, $0 \leq x \leq 0.1$, $0.09 \leq y \leq 0.18$, $6.0 \leq z \leq 7.5$ lead to magnetic materials with unexpectedly large maximum energy product and with a newly found two phase structure. Magnetic materials with maximum energy product of over 13 MG·Oe (megagauss) oersted), residual induction over 7000 G and intrinsic coercive force over 3000 Oe are obtained by subjecting the compositions to a sintering process.

4 Claims, 4 Drawing Figures

HARD MAGNETIC MATERIAL

BACKGROUND OF THE INVENTION

This invention relates to a hard magnetic material, and more particularly to a rare earth cobalt magnet.

Some copper containing rare-earth cobalt materials are known to exhibit high coercive force independent of their grain size. This phenomenon is believed to originate from domain wall stabilization due to fine copper-rich nonmagnetic precipitates. The term "bulk hardening" will be used throughout the specification to denote such an effect. Thus "bulk hardening" means "to invest rare earth cobalt alloys with high coercive force by adding copper". No additives other than copper have been found to cause the effect to the same extent as copper.

One of advantages of the bulk hardening method in producing rare earth cobalt magnets is that one need not pay any special attention to grain size control problem which is often essential in the other methods. Thus, bulk hardening affords easy production.

Shortcomings of the bulk hardening method include severe reduction of saturation induction, which is inevitably caused by a rather heavy incorporation of the nonmagnetic element. The fact that the degree of bulk hardening depends on the amount of copper has been noted for years.

However, the other factors influencing bulk hardening have been noted to a lesser degree. It is worth mentioning here that the degree of bulk hardening greatly depends on kind of rare-earth or rare-earth combinations employed and on rare-earth to cobalt (plus copper) ratio.

Cerium cobalt and samarium cobalt (iron may be added) with 1:5 stoichiometry are good examples in which the bulk hardening has been successfully employed to obtain excellent magnets with maximum energy product of 12 MG.Oe and residual induction of 7000 G. In contrast, $PrCo_5$ exhibits no significant bulk hardening.

U.S. Pat. No. 3,560,200 claims that bulk hardening effectively works in nonstoichiometric compositions in which rare-earth to cobalt (plus copper) ratio falls between 1:5 to 1:8.5 "to a comparative degree" with respect to the 1:5 stoichiometry cases. It is generally expected that increasing the relative amount of cobalt to rare earth increases intrinsic saturation induction, and thus improves maximum energy product. However, it has been generally believed that the increase in the relative amount of cobalt to rare earth weakens the bulk hardening effect, thus requiring more copper addition which in turn diminishes intrinsic saturation induction. Thus, the extension of the composition to the Co-rich side has been considered to bring a similar characteristics, at most to 1:5 stoichiometric cases.

Strnat, in a review article in IEEE Trans. on magnetics vol. MAG-8, No. 3, pp 514 (1972), states that the attained maximum energy product of 12 MGOe (for 1:5 Ce-Co and Sm-Co cases) probably represents maximum obtainable with the bulk hardening method. However, since bulk hardening is greatly affected by the kind of rare earth employed, there is no reason to deny that special combinations of rare earth elements would possibly enhance bulk hardening even for the nonstoichiometric compositions.

An object of the present invention is to provide a novel and improved magnetic materials having high saturation induction, high coercive force and high maximum energy product.

Another object of the invention is to provide an improved magnetic materials having the $CaCu_5$ type hexagonal crystal structure and being characterized by the improved characteristics.

Further object of the invention is to provide a novel rare earth cobalt magnet made by sintering.

These objects are realized by providing the magnetic materials according to the invention having the compositions of $Sm_uCe_{1-u}(Co_{1-x-y}Fe_xCu_y)_z$ in which $0.3 \leq u \leq 1.0$, $0 \leq x \leq 0.1$, $0.09 \leq y \leq 0.18$ and $6.0 \leq z \leq 7.5$.

BRIEF DESCRIPTION OF THE DRAWINGS

These and objects and features and advantages of the present invention will be understood in consideration of the following detailed description, with reference to the attached drawings wherein.

DETAILED DESCRIPTION OF THE INVENTION

The invention is most suitably described in terms of a general composition formula $$Sm_uCe_{1-u}(Co_{1-x-y}Fe_xCu_y)_z.$$

According to the invention, bulk hardening is unexpectedly marked when the parameters $u,x,y,z$ are in a limited range of $0.3 \leq u \leq 1.0$, $0 \leq x \leq 0.1$, $0.09 \leq y \leq 0.18$, and $6.0 \leq z \leq 7.5$. Magnetic materials with maximum energy product of 13 to 20 MGOe can be obtained when suitable manufacturing methods are applied to a composition in the limited range. Such maximum energy product values are much higher than those previously attained with any other bulk hardened rare-earth cobalt magnets.

Although as cast bulk hardened materials exhibit substantial magnet properties, it is important to follow a sintering method in order to obtain a better alignment of the easy axis, and accordingly, higher residual induction and maximum energy product, and to obtain a product homogeneous both in metallurgical structures and magnetic properties.

According to the manufacturing method of the invention, mixed ingredient metals are melted in an inert atmosphere and cast into an iron mold. Ingots are crushed to a course grain and coarse grains are milled into fine grains. Powder thus obtained is pressed into a green tablet with or without an organic liquid under a magnetic field sufficient to cause the easy axis alignment. Green tablets are sometimes further compacted with an isostatic pressure. Green tablets are sintered in vacuum or an inert atmosphere to obtain a dense sintered body. Sintered bodies are furnace-cooled or rapidly cooled and heated at a lower temperature than the sintering temperature. If the heating temperature is proper, the rapidly cooled and heated specimens exhibit better magnetic characteristics than those of furnace-cooled specimens.

Figure 1:
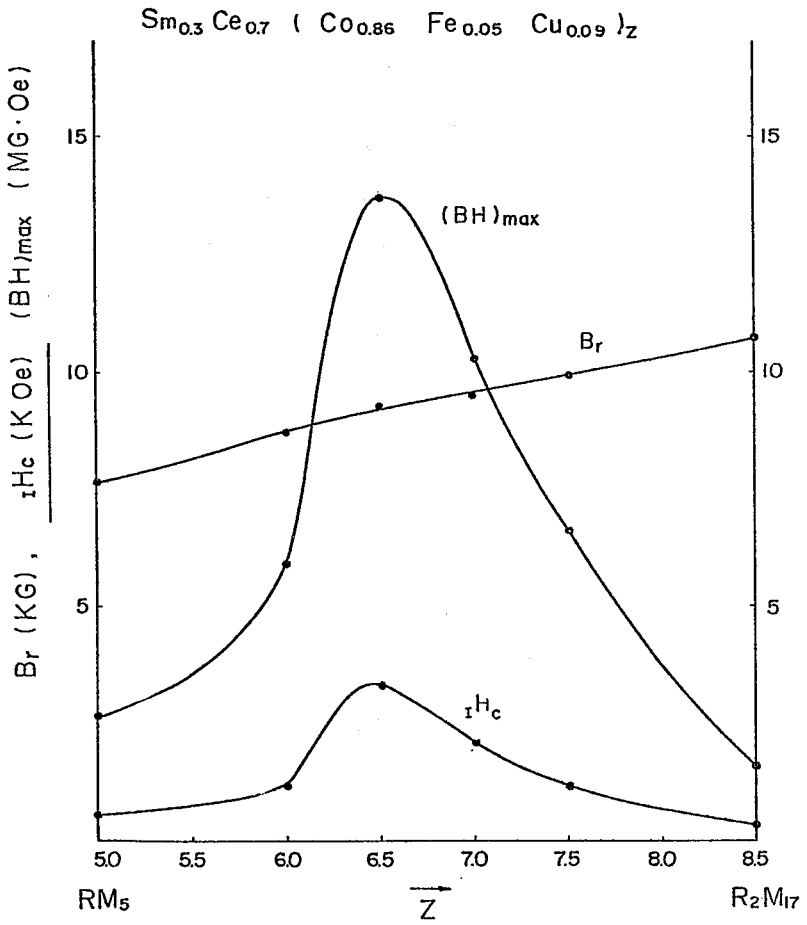
FIG. 1 shows residual magnetic induction $B_r$, intrinsic coercive force ${}_IH_C$ and maximum energy product $(BH)_{max}$ for specimens having the compositions $Sm_{0.3}Ce_{0.7}(Co_{0.86}Fe_{0.05}Cu_{0.09})_z$, as functions of Z.
Figure 2:
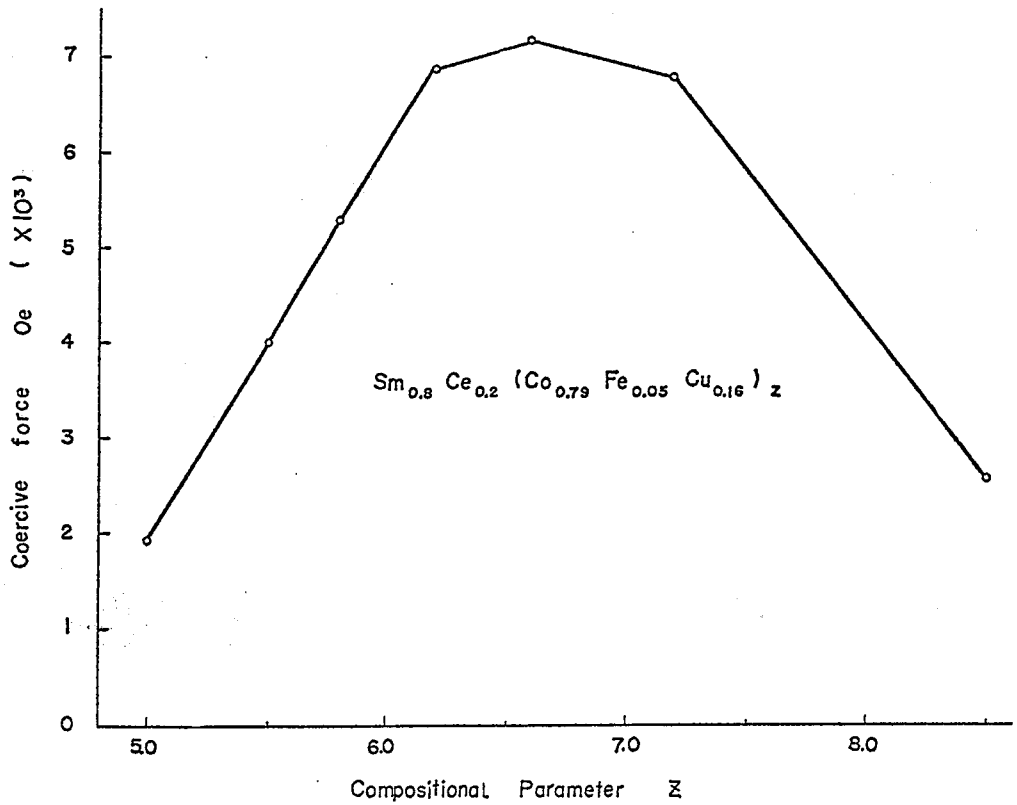
FIG. 2 shows intrinsic coercive force ${}_IH_C$ for specimens having the compositions $Sm_{0.8}Ce_{0.2}(Co_{0.79}Fe_{0.05}Cu_{0.16})_z$, as functions of $z$.
Figure 3:
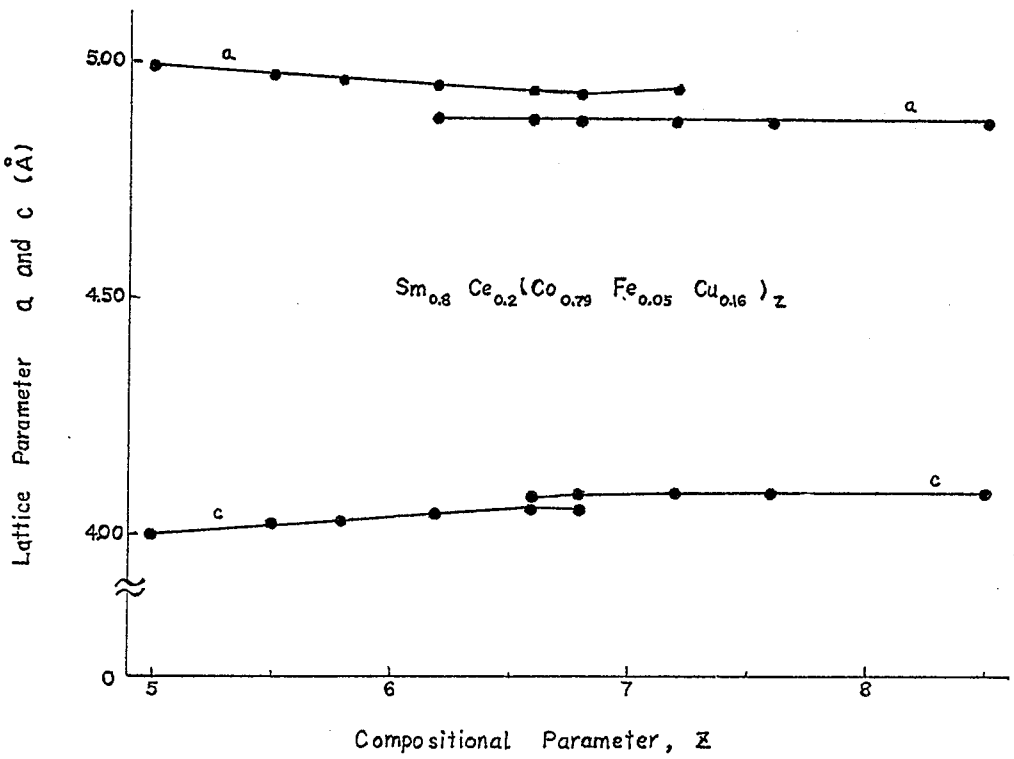
FIG. 3 shows the lattice parameters of $Sm_{0.8}Ce_{0.2}(Co_{0.79}Fe_{0.05}Cu_{0.16})_z$.

The most important features of the invention will be best understood by inspecting FIG. 1, FIG. 2 and FIG. 3. FIG. 1 shows the z-dependence of residual induction $B_r$, intrinsic coercive force ${}_IH_C$, and maximum energy product $(BH)_{max}$ in a special series of the compositions represented by $Sm_{0.3}Ce_{0.7}(Co_{0.86}Fe_{0.05}Cu_{0.09})_z$. At the both ends of $z$, i.e.$z$=5 and $z$=8.5, intrinsic coercive force ${}_IH_C$ are not significantly large. It is consistent with the previous observations that significant bulk hardening does not occur for such a low y value as 0.09 in $Ce(Co,Cu)_5$, $Sm(Co,Cu)_5$ and $Sm(CO,Cu)_{8.5}$; However, for the $z$ values between 6.0 and 7.5, intrinsic coercive force ${}_IH_C$ takes a significantly larger value than that for the other $z$ values. Note that maximum energy product takes a maximum for a $z$ value of about 6.5. For the extreme case of $u$= 0, no appreciable maximum occurs in ${}_IH_C$ vs. $z$ curves. When $0.3 \leq u \leq 1.0$ such a maximum in ${}_IH_C$ v.s. $z$ curves as well as $(BH)_{max}$ v.s.z curves occur at a $z$ value between 6.0 and 7.5.

FIG. 2 shows the $z$ dependence of intrinsic coercive force in $Sm_{0.8}Ce_{0.2}(Co_{0.79}Fe_{0.05}Cu_{0.16})_z$. It is seen from this figure that coercive force is a maximum when $6 \leq z \leq 7.5$. Table 1 summerizes the results of x-ray powder diffraction analysis of specimens with composition $Sm_{0.8}Ce_{0.2}(Co_{0.79}Fe_{0.05}Cu_{0.16})_z$. It has been known that $RCo_5$ has the hexagonal $CaCu_5$ crystal structure and $R_2Co_{17}$ has either hexagonal $Th_2Ni_{17}$ or rhombohedral $Th_2Zn_{17}$ structure. Therefore, one expects the present specimens to exist in either $CaCu_5$ type or 2–17 type (either $Th_2Ni_{17}$ or $Th_2Zn_{17}$) crystal structure or in two or more phases of these structures.

The alloys with $z$ values of 5.0, 5.5 and 5.8 were identified as of $CaCu_5$ type. The alloys with $z$ values of 6.2, 6.6, 6.8 and 7.2 were recognized as having as two phases both with $CaCu_5$ type structure with different lattice parameters. In these cases no superlattice lines of the $Th_2Ni_{17}$ type structure were observed. The diffaction pattern of the alloys with $z$ value of 7.6 and 8.5 were also conveniently indexed by assuming a $CaCu_5$ unit cell, although a few of very weak superlattice lines of the $Th_2Ni_{17}$ type structure were also observed.

The lattice parameters are plotted against $z$ in FIG. 3. Inspecting FIG. 3 together with FIG. 2, it is noted that coercive force is a maximum for the $z$ values where the alloy exists in the two phases. It is also noted that the two phases recognized are both of $CuCu_5$ type and not a mixture of $CuCu_5$ and either $Th_2Ni_{17}$ or $Th_2Zn_{17}$ type. It is reasonable to consider that the said anomalous bulk hardening is correlated to this newly found two phase structure.

Following are the examples of the present invention.

Alloys of $Sm_{0.8}Ce_{0.2}(Co_{0.79}Fe_{0.05}Cu_{0.16})_{7.2}$ were prepared by melting about 500 grams of ingredient mixed metals in an alumina crucible in argon by means of induction heating. The molten alloys were cast in an iron mold. The ingots thus obtained were crushed in an iron mortar into course grains and these were pulverized by nitrogen jet milling into fine powder of an average particle size of about 5$\mu$m. The powder was mixed with toluene and pressed into a green tablet under a magnetic field of about 15000 Oe perpendicular to the pressing direction. The green tablets were further compacted with a hydrostatic pressure of about 4 tons/cm$^2$ to a packing density of about 65 %. The tablets were then sintered in vacuum ($10^{-4}$ to $10^{-5}$ Torr) in an electric furnace with a graphite heater at about 1080°C for 30 minutes. The sintered bodies were quenched on a cool iron plate in argon gas. The quenched samples were first heated at 460°C for 1 hour at approximately $5\times10^{-5}$ Torr and then furnace-cooled to room temperature. The samples were heated repeatedly at successively higher temperatures and furnace-cooled. The coercive force of the samples was measured after each heat treatment.

Figure 4:
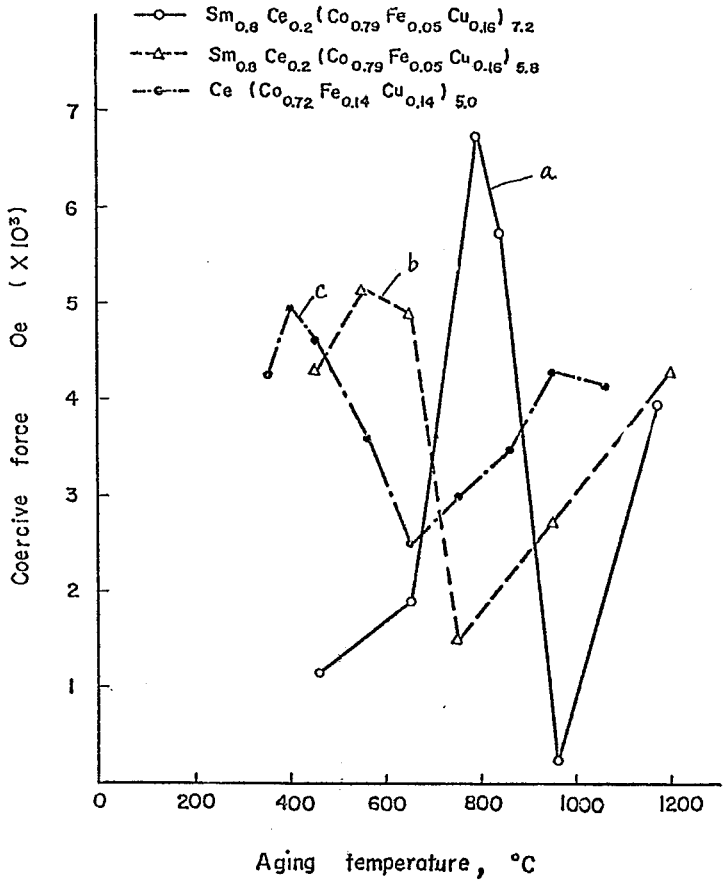
FIG. 4 shows coervice force of various samples plotted against heating temperature.

The coercive force is shown as a function of the heating temperatures by curve (a) in FIG. 4. With increasing heating temperature, coercive force increases until a maximum value is reached and then decreases to a minimum value. Similar curves (b) and (c) taken on samples having $z$ values of 5.8 and 5.0 are also plotted in the same figure for the purpose to make comparison with the present example. The optimum heating temperature at which the maximum coercive force occurs is higher when $z$ is larger.

Table 2. lists magnetic properties of the samples with various compositions, prepared by the above stated method. It is seen from Table 2 that maximum energy product higher than 13 MGOe is obtained in the claimed range of $u$, $x$, $y$, $z$ of the invention.

Table 1

| | Compositional Parameter, Z (u=0.8, x=0.05, y=0.16) | | | | | | | | | |
|---|---|---|---|---|---|---|---|---|---|---|
| | 5.0 | | 5.5 | | 5.8 | | 6.2 | | 6.6 | |
| h k l | d(A) | I | d(A) | I | d(A) | I | d(A) | I | d(A) | I |
| 1 0 0 | 4.308 | w | 4.287 | vw | 4.287 | vw | | | | |
| 0 0 1 | 3.987 | m | 4.017 | wm | 4.022 | wm | 4.037 | wm | 4.055 | vw |
| ⅓ ⅓ 1 | | | | | | | | | | |
| 1 0 1 | 2.930 | vs | 2.930 | vs | 2.937 | vs | 2.943 | vs | 2.943 | vs |
| ⅔ ⅔ 1 | | | | | | | | | | |
| 1 1 0 | 2.494 | vs | 2.476 | s | 2.475 | s | 2.473 | m | 2.469 | m |
| | | | | | | | 2.440 | wm | 2.440 | m |
| 2 0 0 | 2.160 | vs | 2.145 | s | 2.144 | s | 2.140 | ms | 2.137 | m |
| | | | | | | | | | 2.111 | vs |
| 1 1 1 | 2.116 | vs | 2.111 | vs | 2.111 | vs | 2.112 | vs | 2.096 | vs |
| | | | | | | | | | 2.039 | m |
| 0 0 2 | 2.000 | s | 2.011 | ms | 2.013 | s | 2.021 | m | 2.028 | m |
| | | | | | | | | | 1.890 | w |
| 2 0 1 | 1.901 | wm | 1.894 | wm | 1.932 | wm | 1.890 | w | 1.875 | wm |
| 1 0 2 | | | | | | | | | | |
| ⅔ ⅔ 2 | | | | | | | | | | |
| — | | | | | | | | | | |
| 1 1 2 | 1.562 | m | 1.564 | m | 1.564 | m | 1.564 | wm | 1.567 | wm |
| | | | | | | | | | 1.500 | vw |
| 2 1 1 | 1.513 | m | 1.507 | wm | 1.507 | wm | 1.504 | wm | 1.485 | w |
| | | | | | | | 1.489 | w | | |
| 2 0 2 | 1.470 | m | 1.470 | ms | 1.470 | m | 1.472 | m | 1.470 | wm |
| 3 0 0 | 1.443 | w | 1.434 | vvw | 1.434 | vvw | 1.430 | vvw | | |
| — | | | | | | | | | | |

Table 1-continued

| | Compositional Parameter, Z (u=0.8, x=0.05, y=0.16) | | | | | | | | | |
|---|---|---|---|---|---|---|---|---|---|---|
| | 5.0 | | 5.5 | | 5.8 | | 6.2 | | 6.6 | |
| h k l | d(A) | I | d(A) | I | d(A) | I | d(A) | I | d(A) | I |
| | | | | | | | | | 1.344 | vw |
| 301,003 | 1.357 | m | 1.350 | wm | 1.350 | m | 1.348 | w | 1.332 | vw |
| 1 0 3 | 1.276 | vvw | 1.280 | vvw | 1.283 | vvw | | | 1.292 | vvw |
| 2 2 0 | 1.248 | wm | 1.243 | wm | 1.240 | wm | 1.237 | vw | 1.219 | vvw |
| 221,113 | 1.178 | wm | 1.181 | wm | 1.181 | wm | 1.184 | w | 1.186 | w |
| 3 0 2 | 1.171 | w | 1.168 | vvw | 1.167 | vw | | | | |
| 3 1 1 | 1.150 | vw | 1.143 | vvw | 1.142 | vvw | | | | |
| 4 0 0 | 1.033 | vvw | 1.074 | vvw | | | | | 1.056 | vw |
| 2 2 2 | 1.060 | wm | 1.057 | w | 1.057 | wm | 1.057 | vw | | |
| 2 1 3 | 1.035 | vvw | 1.036 | vvw | | | | | | |

| | 6.8 | | 7.2 | | 7.6 | | 8.5 | |
|---|---|---|---|---|---|---|---|---|
| h k l | d(A) | I | d(A) | I | d(A) | I | d(A) | I |
| 1 0 0 | | | | | | | 4.207 | vw |
| 0 0 1 | 4.053 | vw | 4.070 | vw | 4.092 | vvw | 4.075 | vvw |
| ⅓ ⅓ 1 | | | | | | | 3.497 | vvw |
| 1 0 1 | 2.939 | vs | 2.938 | s | 2.938 | s | 2.932 | s |
| ⅔ ⅔ 1 | | | | | 2.704 | vvw | 2.696 | vvw |
| | 2.466 | m | 2.471 | m | | | | |
| 1 1 0 | 2.437 | ms | 2.440 | ms | 2.439 | s | 2.435 | s |
| | 2.135 | s | 2.139 | m | | | | |
| 2 0 0 | 2.111 | vs | 2.111 | vs | 2.110 | vs | 2.110 | vs |
| 1 1 1 | 2.097 | vs | 2.097 | vs | 2.092 | vs | 2.093 | vs |
| | 2.043 | m | | | | | | |
| 0 0 2 | 2.026 | m | 2.043 | m | 2.043 | m | 2.042 | s |
| | 1.889 | wm | | | | | | |
| 2 0 1 | 1.875 | wm | 1.876 | m | 1.943 | vvw | 1.874 | m |
| 1 0 2 | | | | | 1.874 | m | 1.838 | vvw |
| ⅔ ⅔ 2 | | | | | | | 1.779 | vvw |
| — | | | | | | | 1.657 | vvw |
| 1 1 2 | 1.566 | wm | 1.567 | wm | 1.567 | vw | 1.565 | w |
| | 1.502 | w | | | | | | |
| 2 1 1 | 1.487 | wm | 1.487 | wm | 1.487 | wm | 1.485 | m |
| 2 0 2 | 1.467 | m | 1.468 | m | 1.468 | wm | 1.467 | wm |
| 3 0 0 | | | | | 1.407 | vvw | 1.407 | vvw |
| — | | | | | 1.363 | vvw | | |
| | 1.346 | vw | | | | | | |
| 301,003 | 1.330 | w | 1.331 | wm | 1.330 | w | 1.330 | wm |
| 1 0 3 | | | | | 1.295 | vvw | 1.296 | vvw |
| 2 2 0 | 1.219 | w | 1.219 | w | 1.218 | wm | 1.218 | m |
| 221,113 | 1.186 | wm | 1.188 | wm | 1.189 | wm | 1.189 | wm |
| 3 0 2 | | | | | | | | |
| 3 1 1 | | | | | 1.125 | vvw | 1.124 | vvw |
| 4 0 0 | 1.055 | w | 1.056 | w | 1.055 | w | 1.055 | wm |
| 2 2 2 | | | 1.046 | w | 1.046 | w | 1.046 | w |
| 2 1 3 | | | | | | | | |

Table 2

| Composition | | | | Sint. | Heat. | Magnetic Properties | | |
|---|---|---|---|---|---|---|---|---|
| u | x | y | z | Temp. | Temp. | Br | Hc | (BH) max |
| 0.80 | 0.05 | 0.16 | 5.0 | 1150 | 400 | 8000 | 1950 | 9.1 |
| 0.80 | 0.05 | 0.16 | 5.5 | 1160 | 540 | 8250 | 2850 | 13.8 |
| 0.70 | 0.05 | 0.16 | 5.8 | 1150 | 540 | 8050 | 6400 | 15.1 |
| 0.80 | 0.05 | 0.16 | 5.8 | 1200 | 540 | 8000 | 5150 | 15.6 |
| 0.80 | 0.05 | 0.16 | 6.2 | 1180 | 540 | 8100 | 6850 | 16.0 |
| 0.80 | 0.05 | 0.16 | 6.6 | 1180 | 540 | 8950 | 7200 | 17.4 |
| 0.70 | 0.05 | 0.15 | 6.8 | 1160 | 790 | 7650 | 6100 | 13.1 |
| 0.65 | 0.05 | 0.15 | 7.0 | 1160 | 790 | 8500 | 6050 | 16.5 |
| 0.70 | 0.05 | 0.13 | 7.0 | 1180 | 790 | 9050 | 3050 | 17.0 |
| 0.70 | 0.05 | 0.15 | 7.0 | 1170 | 790 | 8850 | 6400 | 18.2 |
| 0.70 | 0.10 | 0.18 | 7.0 | 1150 | 790 | 9000 | 5500 | 15.8 |
| 0.80 | 0.05 | 0.15 | 7.0 | 1170 | 790 | 9050 | 6800 | 19.7 |
| 0.80 | 0.10 | 0.15 | 7.0 | 1160 | 790 | 9900 | 5000 | 16.7 |
| 0.65 | 0.05 | 0.16 | 7.2 | 1160 | 790 | 8400 | 6000 | 16.0 |
| 0.70 | 0.05 | 0.14 | 7.2 | 1170 | 790 | 9050 | 6900 | 18.6 |
| 0.70 | 0.05 | 0.16 | 7.2 | 1160 | 790 | 9150 | 6450 | 18.3 |
| 0.70 | 0.06 | 0.15 | 7.2 | 1170 | 790 | 9350 | 5000 | 18.3 |
| 0.75 | 0.03 | 0.15 | 7.2 | 1170 | 790 | 8950 | 5000 | 17.9 |
| 0.75 | 0.04 | 0.15 | 7.2 | 1170 | 790 | 9200 | 5200 | 20.2 |
| 0.75 | 0.05 | 0.16 | 7.2 | 1170 | 790 | 9250 | 6500 | 18.7 |
| 0.80 | 0.05 | 0.13 | 7.2 | 1180 | 790 | 8900 | 3000 | 13.8 |
| 0.80 | 0.05 | 0.14 | 7.2 | 1180 | 790 | 9700 | 4850 | 20.0 |
| 0.80 | 0.05 | 0.15 | 7.2 | 1170 | 790 | 9350 | 4150 | 18.7 |
| 0.80 | 0.05 | 0.16 | 7.2 | 1180 | 790 | 9150 | 6750 | 19.7 |
| 0.90 | 0.05 | 0.16 | 7.2 | 1180 | 790 | 8350 | 6500 | 16.6 |
| 0.90 | 0.05 | 0.17 | 7.2 | 1180 | 790 | 8050 | 6300 | 15.1 |
| 0.90 | 0.05 | 0.18 | 7.2 | 1180 | 790 | 7650 | 6100 | 13.3 |
| 0.70 | 0.05 | 0.15 | 7.3 | 1170 | 790 | 9100 | 5950 | 18.6 |
| 0.70 | 0.05 | 0.15 | 7.6 | 1170 | 810 | 9450 | 4000 | 17.0 |

Table 2-continued

| Composition | | | | Sint. | Heat. | Magnetic Properties | | |
|---|---|---|---|---|---|---|---|---|
| u | x | y | z | Temp. | Temp. | Br | Hc | (BH) max |
| 0.80 | 0.05 | 0.16 | 8.5 | 1180 | 810 | 8950 | 2550 | 9.7 |

What is claimed is:

1. A magnetic material consisting essentially of a composition expressed by the formula $Sm_uCe_{1-u}(Co_{1-x-y}Fe_xCu_y)_z$ where $0.3 \leq u \leq 1.0$, $0 \leq x \leq 0.1$, $0.09 \leq y \leq 0.18$ and $6.0 \leq z \leq 7.5$, and having a residual induction of more than 7000G, an intrinsic coercive force of more than 3000 Oe and a maximum energy product of more than 13 Mg.Oe.

2. A magnetic material as claimed in claim 1, wherein said material consists of two phases, both of which are of the $CaCu_5$ type hexagonal crystal structure.

3. A method of manufacturing the magnetic material consisting essentially of a composition expressed by the formula $Sm_uCe_{1-u}(Co_{1-x-y}Fe_xCu_y)_z$ where $0.3 \leq u \leq 1.0$, $0 \leq x \leq 0.1$, $0.09 \leq y \leq 0.18$ and $6.0 \leq z \leq 7.5$, and having a residual induction of more than 7000G, an intrinsic coercive force of more than 3000 Oe and a maximum energy product of more than 13 MG.Oe, comprising, in the following recited order, preparing a raw material consisting essentially of said composition, pressing said raw material into a green body under a magnetic field sufficient to cause easy axis alignment thereof, sintering said green body into a sintered body, cooling rapidly said sintered body, and heating the thus cooled sintered body at a temperature lower than a temperature used in said sintering.

4. A method of manufacturing the magnetic material of claim 3, wherein said material consists of two phases, both of which are of the $CaCu_5$ type hexagonal crystal structure.

* * * * *